US007488219B2

(12) United States Patent
Matsumura

(10) Patent No.: US 7,488,219 B2
(45) Date of Patent: Feb. 10, 2009

(54) ONBOARD CONNECTOR

(75) Inventor: Kaoru Matsumura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/540,603

(22) Filed: Oct. 2, 2006

(65) Prior Publication Data

US 2007/0077813 A1 Apr. 5, 2007

(30) Foreign Application Priority Data

Sep. 30, 2005 (JP) ..... P2005-289105

(51) Int. Cl.
*H01R 13/40* (2006.01)

(52) U.S. Cl. ..... 439/751; 439/733.1; 439/82; 439/943

(58) Field of Classification Search ..... 439/751, 439/82, 733.1, 943, 83, 571
See application file for complete search history.

(56) References Cited

U.S. PATENT DOCUMENTS 4,526,429 A * 7/1985 Kirkman ..... 439/82
4,676,579 A * 6/1987 Ting ..... 439/825
4,973,260 A * 11/1990 Madore et al. ..... 439/101
4,992,057 A * 2/1991 Smit ..... 439/83
6,979,234 B2 * 12/2005 Bleicher ..... 439/733.1

FOREIGN PATENT DOCUMENTS

JP 2004-47323 A 2/2004
JP 2005-222771 A 8/2005

* cited by examiner

*Primary Examiner*—Renee Luebke
*Assistant Examiner*—Xuong M Chung-Trans
(74) *Attorney, Agent, or Firm*—Sughrue Mion, PLLC

(57) ABSTRACT

An onboard connector is mounted on a circuit board. The onboard connector includes a plurality of terminals, each of which having a first electrical contact portion formed at one end portion thereof so as to be electrically connected to a mating connector and a second electrical contact portion formed at the other end portion thereof so as to be press-fitted into the corresponding through-hole land to electrically contact an inner peripheral surface of the through-hole land, the second electrical contact portion being plated, and a connector housing including a plurality of terminal receiving chambers which are open to a lower face of the connector housing. The terminals are received in the connector housing so that the second electrical contact portions project from the lower surface of the connector housing through openings of the respective terminal receiving chambers. An opening peripheral surface of each terminal receiving chamber which defines the opening forms a plating shaving-receiving portion for receiving plating shavings which are shaved from the plating on the second electrical contact portion by the through-hole land when the second electrical contact portion is press-fitted into the through-hole land.

10 Claims, 6 Drawing Sheets

ONBOARD CONNECTOR

BACKGROUND OF THE INVENTION

This invention relates to an improved onboard connector (that is, a circuit board directly-mounting connector) provided with a connector housing receiving terminals (made of electrically-conductive metal) which are inserted into respective through-hole lands (made of electrically-conductive metal) in a circuit board to be electrically connected thereto.

There is known one related onboard connector (connector for mounting on a board) in which a jig receiving surface against which a press-fitting jig is adapted to abut is formed at each of terminals which are to be press-fitted into respective through-hole lands (through holes) in a circuit board, and when the terminal is press-fitted into the through-hole land, a pressing force from the press-fitting jig is received by the jig receiving surface, thereby preventing deformation of a connector housing (see, for example, JP-A-2005-222771). This onboard connector is the type of connector in which electrical connection portions of the terminals, mounted in the connector housing, are press-fitted into the respective through-hole lands (which form part of an electrically-conductive circuit pattern of the circuit board) to be electrically connected thereto.

Generally, plating is applied to an outer surface of the terminal, and when the electrical connection portion is press-fitted into the through-hole land, the plating of the electrical connection portion is, in some cases, shaved or scraped by an edge (or corner) of an inlet portion of the through-hole land to produce plating shavings (that is, plating flakes shaved from the plating). When this plating shaving contacts the adjacent terminals in a bridging manner, there is a possibility that the short-circuiting between the adjacent terminals through this plating shaving occurs, and therefore an improvement is necessary in this respect.

However, when the onboard connector, disclosed in JP-A-2005-222771, is mounted on the circuit board while press-fitting the terminals into the respective through-hole lands, a space in which the terminals are disposed is formed between the connector housing and the circuit board, and therefore there is a high possibility that the above short-circuiting between the terminals occurs.

Referring to other related onboard connectors, there is known one (connector for mounting on a board) in which recesses are formed in an end surface of a bottom wall portion (having terminal passage holes) facing a hood portion (that is, facing a mating connector), and are continuous with the respective terminal passage holes (see, for example, JP-A-2004-47323). This connector is of such a construction that when the terminal is inserted into the terminal passage hole, shavings, produced by the rubbing of the terminal on the terminal passage hole portion, are received in the recess, thereby preventing the onboard connector from being incompletely fitted in the mating connector.

The onboard connector disclosed in this JP-A-2004-47323 is designed to overcome the incomplete fitting connection to the mating connector which is caused by shavings (shaved or scraped from a connector housing made of a synthetic resin or the like) held between this onboard connector and the mating connector. Thus, this onboard connector does not teach or suggest the above-mentioned short-circuiting between the terminals, and does not contribute to improvement of this point.

SUMMARY OF THE INVENTION

This invention has been made in view of the above circumstances, and an object of the invention is to provide an onboard connector in which even when plating shavings are produced at the time of press-fitting an electrical connection portion of each terminal into a through-hole land in a circuit board, the short-circuiting between the terminals by the plating shaving can be positively prevented.

In order to achieve the above object, according to the present invention, there is provided an onboard connector adapted to be mounted on one of upper and lower faces of a circuit board so that the onboard connector is electrically connected to through-hole lands extending through from the upper face to the lower face of the circuit board, the onboard connector comprising:

a plurality of terminals, each of which having:

a first electrical contact portion formed at one end portion thereof for electrically connecting a mating connector; and a second electrical contact portion formed at the other end portion thereof for being press-fitted into the corresponding through-hole land to electrically contact an inner peripheral surface of the through-hole land, the second electrical contact portion being plated; and a connector housing including a plurality of terminal receiving chambers which are open to a lower face of the connector housing, wherein the terminals are received in the connector housing so that the second electrical contact portions project from the lower surface of the connector housing through openings of the respective terminal receiving chambers; and wherein an opening peripheral surface of each terminal receiving chamber which defines the opening forms a plating shaving-receiving portion for receiving plating shavings which are shaved from the plating on the second electrical contact portion by the through-hole land when the second electrical contact portion is press-fitted into the through-hole land.

Preferably, each of the terminals has a holding portion which is held by the connector housing, and an intermediate portion which is provided between the holding portion and the second electrical contact portion. Each of the plating shaving-receiving portions receives the intermediate portion of the each terminal.

Preferably, each of the opening peripheral surfaces is formed such that the terminal receiving chamber spreads outward toward the lower surface of the connector housing, and is open to the lower face.

Preferably, the connector housing has frame-like projections provided on the lower face of the connector housing to be attached to the circuit board. The projections respectively surround the openings.

In the onboard connector of the construction, there are provided the plating shaving-receiving portions each for receiving shavings which are scraped or shaved from the plating on the electrical connection portion by the through-hole land when the second electrical contact is press-fitted into the through-hole land. The onboard connector is mounted on the circuit board in such a manner that the lower surface of the connector housing is disposed in intimate contact with the one surface of the upper and lower faces of the circuit board, with the openings of the terminal receiving chambers closed by the circuit board. Therefore, even when plating shavings are produced, these plating shavings are received in the plating shaving-receiving portions which are closed by the circuit board, and are formed independently of one another by the opening peripheral surfaces of the respective terminal receiving chambers. Therefore, any plating shaving will not move to the adjacent terminal. Therefore, the short-circuiting between the adjacent terminals by the plating shaving can be positively prevented, so that the reliability of the onboard connector is enhanced.

In the construction of the above invention, the terminal receiving chamber may be formed in an outwardly-spreading manner by the opening peripheral surface, thereby forming the plating shaving-receiving portion, or that portion of the terminal surrounded by the opening peripheral surface may be made thin, thereby forming the plating shaving-receiving portion, or both of these forms may be used.

In this connection, in the onboard connector, the opening peripheral surface is formed such that the terminal receiving chamber spreads outward toward the lower surface of the connector housing, and is open to this lower surface. Therefore, the plating shaving-receiving portion of a sufficient capacity can be formed without thinning the terminal, that is, while maintaining a flexural strength of the terminal, and this is desirable. In the construction of the invention, the opening peripheral surface may be formed to increase or spread the inner peripheral surface (defining the terminal receiving chamber) in a stepped manner to thereby form a recess as in a preferred embodiment of the invention described later, or the inner peripheral surface, defining the terminal receiving chamber, may be formed, for example, to spread or flare like a bell of a trumpet.

In the onboard connector of the construction of the invention, the frame-like distal end surface of the frame-like projection (which is formed on and projects from the lower surface of the connector housing in a manner to surround the openings) is entirely held in intimate contact with the one surface of the upper and lower surfaces of the circuit board. Therefore, the intimate contact between the connector housing and the circuit board is enhanced by the frame-like distal end surface of the frame-like projection held against the circuit board, and a gap is prevented from being formed between the connector housing and the circuit board. The frame-like projection can be easily formed at the time of molding the connector housing by a synthetic resin.

In the present invention, there can be provided the onboard connector in which even when plating shavings are produced at the time of press-fitting the second electrical contact portion of each terminal into the through-hole land in the circuit board, the short-circuiting between the terminals by the plating shaving can be positively prevented.

BRIEF DESCRIPTION OF THE DRAWINGS

The above objects and advantages of the present invention will become more apparent by describing in detail preferred exemplary embodiments thereof with reference to the accompanying drawings, wherein.

The present invention has been briefly described above. Details of the invention will become more manifest upon reading the following Section "DETAILED DESCRIPTION OF THE PREFERRED EMBODIMENTS" with reference to the accompanying drawings.

DETAILED DESCRIPTION OF THE PREFERRED EMBODIMENTS

A preferred embodiment of the present invention will now be described in detail with reference to the drawings.

Figure 1:
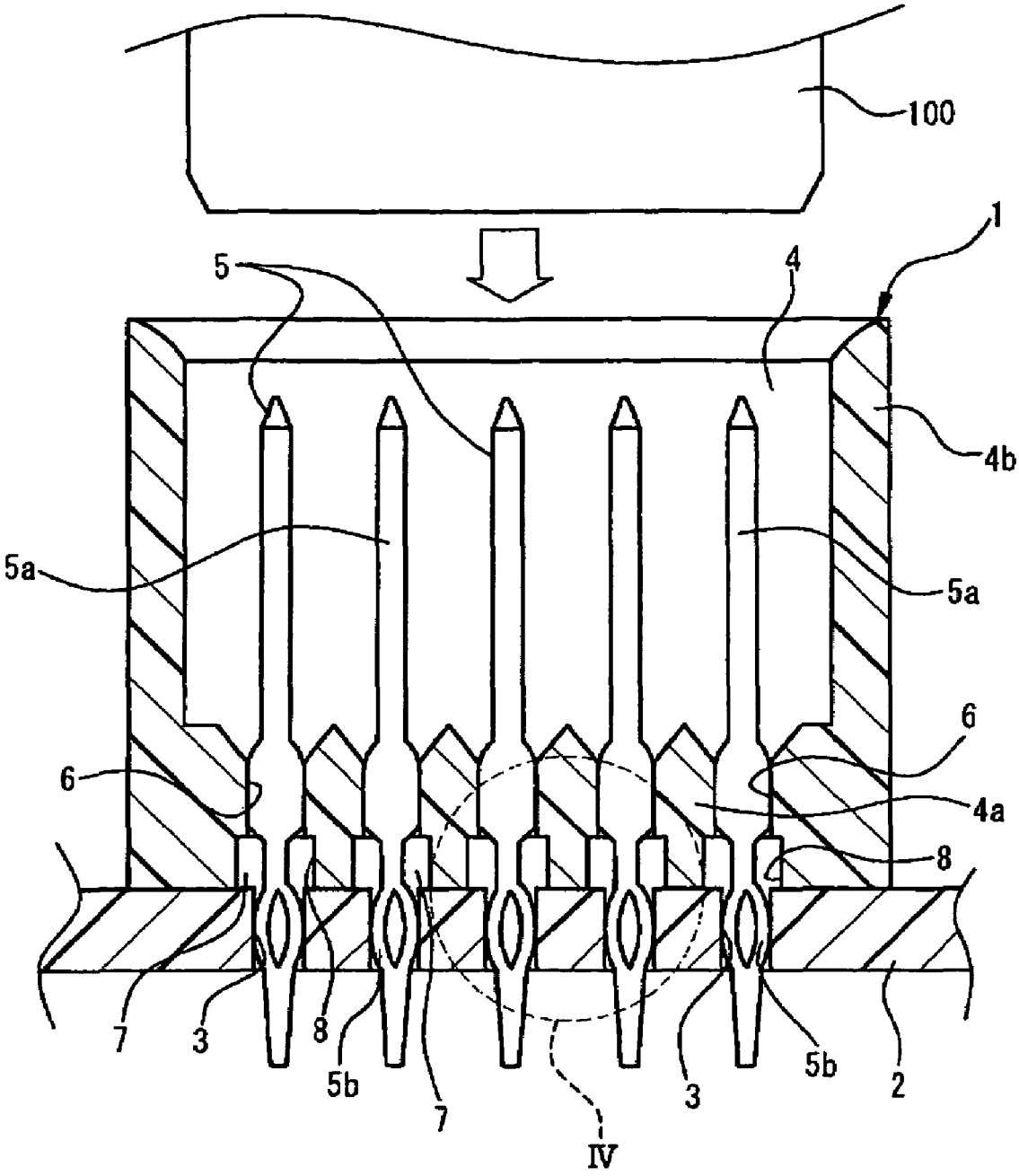
FIG. 1 is a vertical cross-sectional view showing a condition in which one preferred embodiment of an onboard connector of the present invention is mounted on a circuit board.
Figure 2:
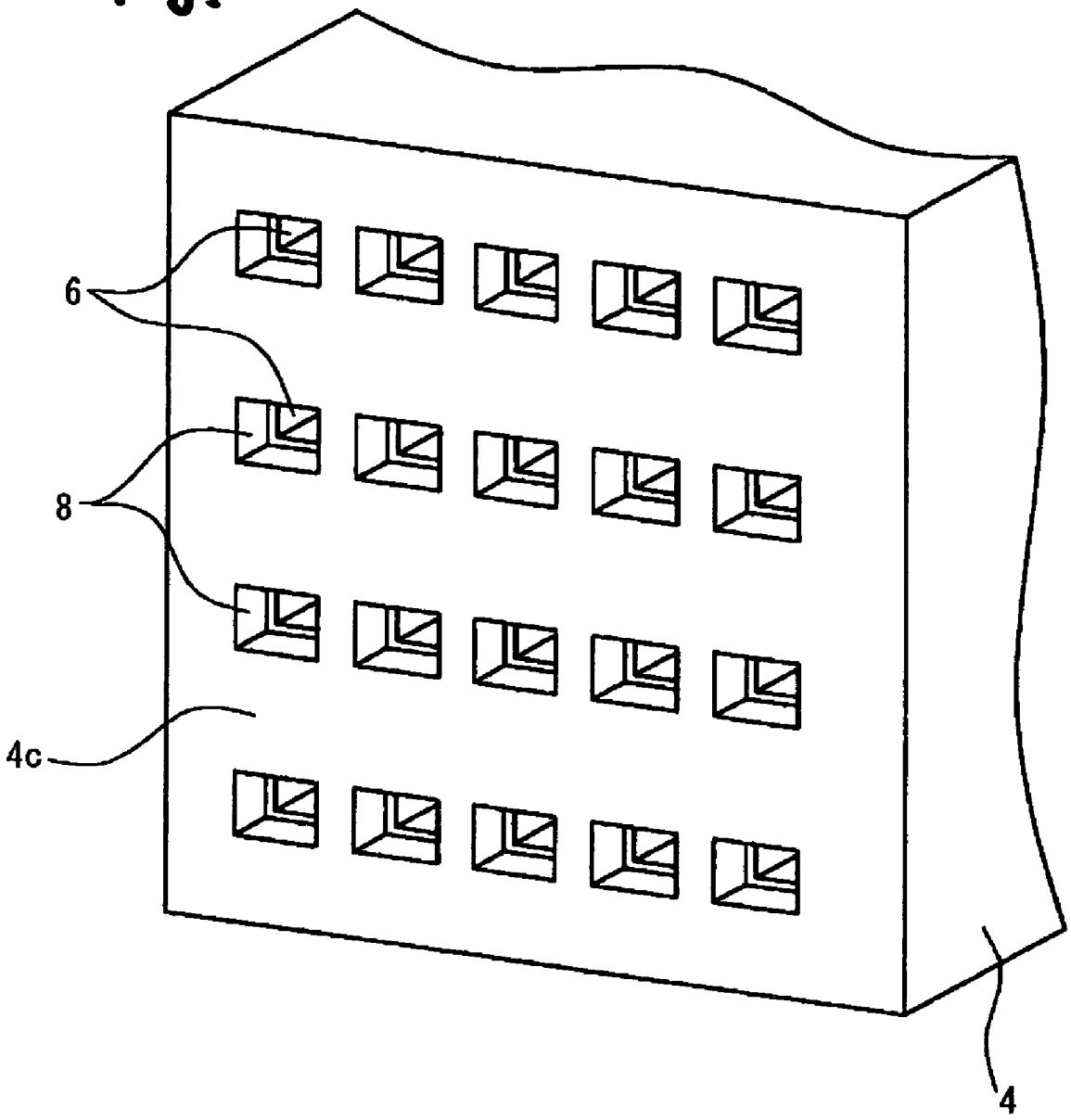
FIG. 2 is an enlarged perspective view showing a lower surface of a connector housing of the onboard connector of FIG. 1 in which openings of a plurality of terminal receiving chambers are formed.
Figure 3:
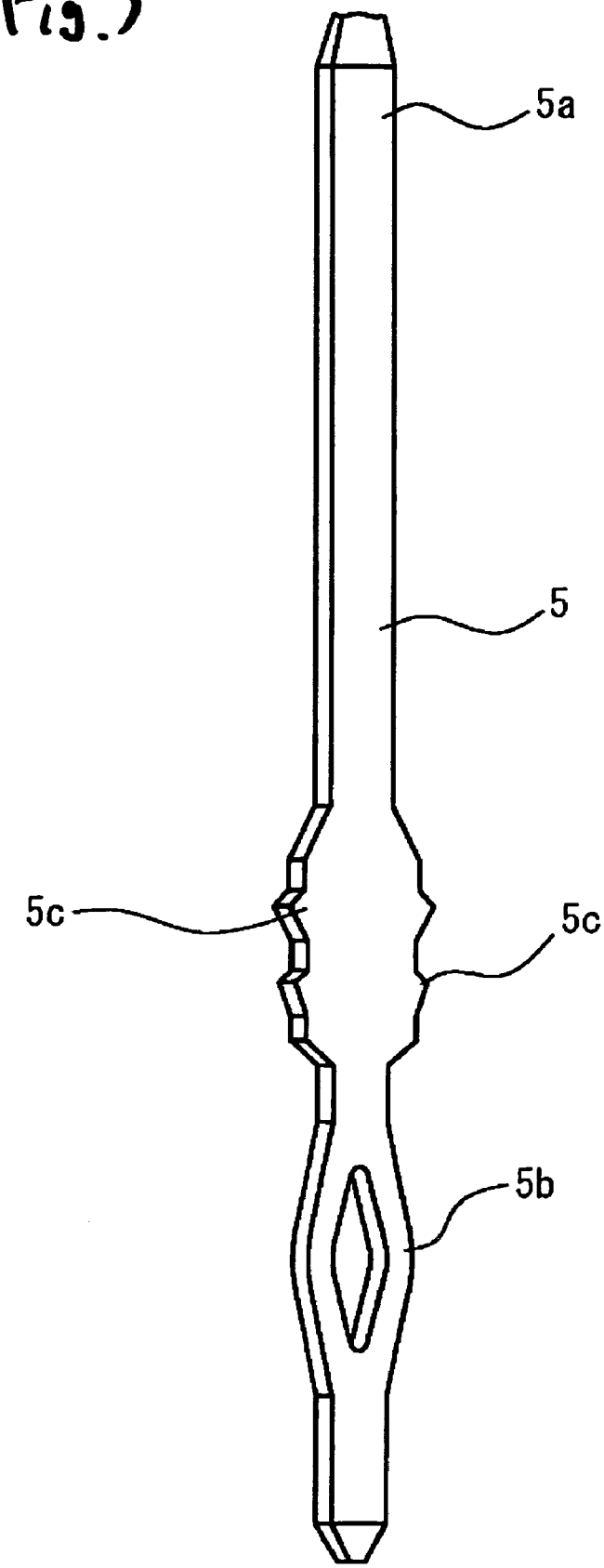
FIG. 3 is a perspective view of a terminal which is to be received in the connector housing of the onboard connector of FIG. 1.
Figure 4:
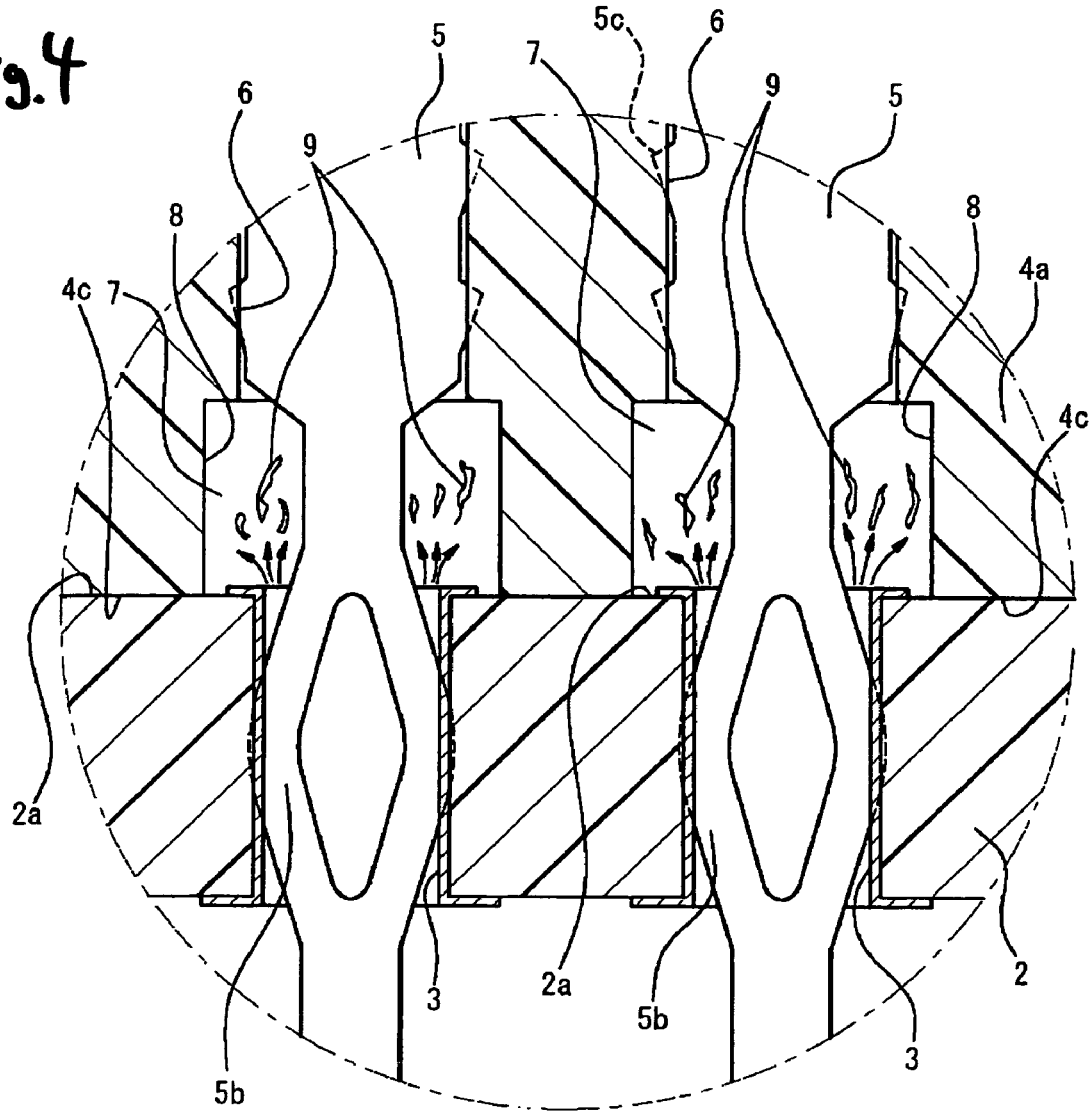
FIG. 4 is an enlarged view of a portion of FIG. 1 encircled by a dot-and-dash circle IV, showing an important portion of the onboard connector of the invention.
Figure 5:
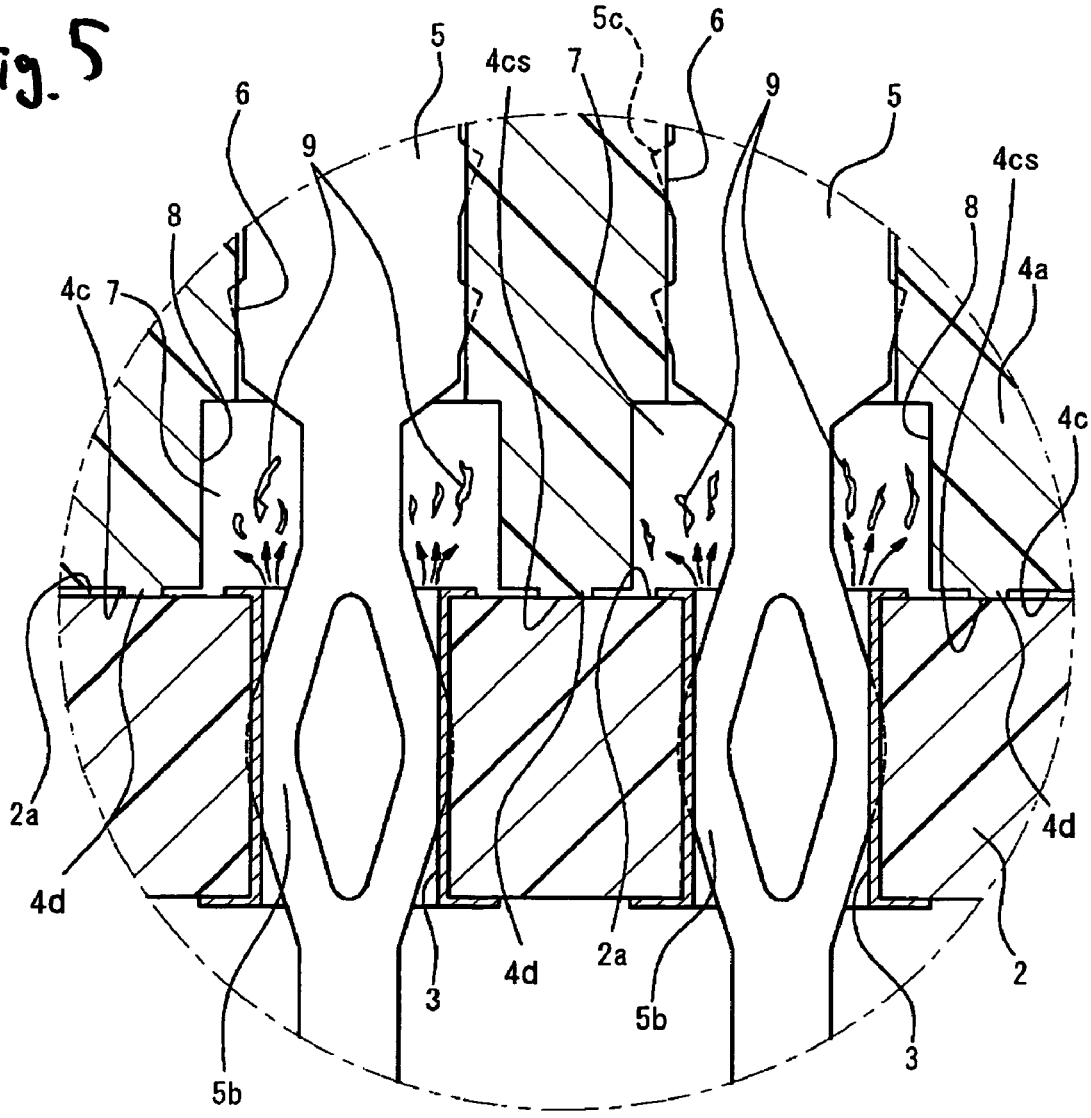
FIG. 5 is an enlarged view similar to FIG. 4, but showing an important portion (that is, a frame-like distal end surface of a frame-like projection formed on a lower surface of a connector housing for intimate contact with a circuit board) of a modified example of the onboard connector of FIG. 1.
Figure 6:
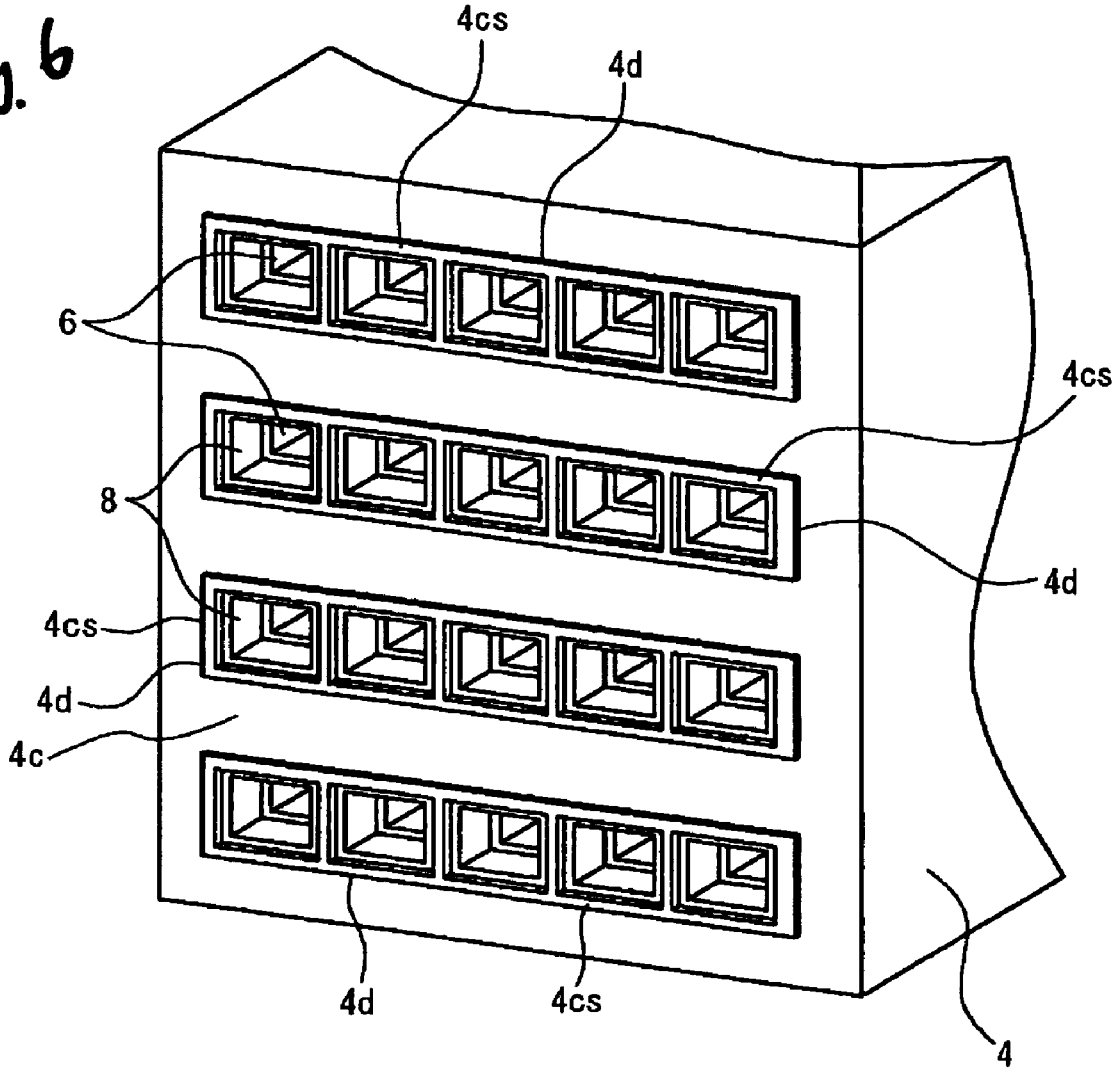
FIG. 6 is an enlarged perspective view showing the lower surface of the connector housing of the modified example on which the frame-like projections of FIG. 5 are formed.

FIG. 1 is a vertical cross-sectional view showing a condition in which one preferred embodiment of an onboard connector of the invention is mounted on a circuit board, FIG. 2 is an enlarged perspective view showing a lower surface of a connector housing of the onboard connector of FIG. 1 in which openings of a plurality of terminal receiving chambers are formed, FIG. 3 is a perspective view of a terminal which is to be received in the connector housing of the onboard connector of FIG. 1, FIG. 4 is an enlarged view of a portion of FIG. 1 encircled by a dot-and-dash circle IV, showing an important portion of the onboard connector of the invention, FIG. 5 is an enlarged view similar to FIG. 4, but showing an important portion (that is, a frame-like distal end surface of a frame-like projection formed on a lower surface of a connector housing for intimate contact with a circuit board) of a modified example of the onboard connector of FIG. 1, and FIG. 6 is an enlarged perspective view showing the lower surface of the connector housing of the modified example on which the frame-like projections of FIG. 5 are formed.

As shown in FIGS. 1 to 4, one preferred embodiment of the onboard connector 1 of the invention can be mounted on one 2*a* of upper and lower surfaces of the circuit board 2 in such a manner that this onboard connector 1 is electrically connected to through-hole lands 3 extending through the upper and lower surfaces of the circuit board 2. This onboard connector 1 includes a plurality of terminals 5 made of electrically-conductive metal, the connector housing 4 made of an insulative synthetic resin, and a plurality of terminal receiving chambers 6 which are formed within the connector housing 4, and are open to the lower surface 4*c* of the connector housing 4. Each of the terminals 5 has an electrical contact portion 5*a* formed at one end portion thereof so as to be electrically connected to a respective one of female terminals (not shown) of a mating connector 100, and an electrical connection portion 5b formed at the other end portion thereof so as to be press-fitted into the corresponding through-hole land 3 to electrically contact an inner peripheral surface of this through-hole land 3. At least the electrical connection portion 5*b* is plated.

The terminals 5 are received respectively in the terminal receiving chambers 6 in such a manner that their electrical connection portions 5*b* project from the lower surface 4*c* of the connector housing 4 through the openings of the respective terminal receiving chambers 6. An opening peripheral surface 8 of each terminal receiving chamber 6 which defines the opening cooperates with the corresponding terminal 5 to form a plating shaving-receiving space 7 therebetween. The plating shaving-receiving space 7 is provided for receiving plating shavings 9 which are scraped or shaved from the plating on the electrical connection portion 5*b* by an edge (or corner) of an inlet portion of the through-hole land 3 when the electrical connection portion 5*b* is press-fitted into the through-hole land 3. The onboard connector 1 is mounted on the circuit board 2 in such a manner that the lower surface 4*c* of the connector housing 4 is disposed in intimate contact with the one surface 2*a* of the upper and lower surfaces of the circuit board 2, with the openings of the terminal receiving chambers 6 closed by the circuit board. Each opening peripheral surface 8 is formed such that the terminal receiving chamber 6 spreads outward toward the lower surface 4*c* of the connector housing 4, and is open to this lower surface 4*c*.

Details of the onboard connector 1 of the above construction will be described below.

The female connector housing 4 is formed by injection molding a synthetic resin, and is a member of a generally square tubular shape with a closed bottom which has a hollow hood portion 4*b* for fitting on the male-type mating connector 100 as shown in FIG. 1. The terminals 5 are inserted and held in the terminal receiving chambers 6, respectively.

As shown in FIG. 2, the plurality of terminal receiving chambers 6 of the same configuration, each defined by an inner peripheral surface including the opening peripheral surface 8, are formed in a bottom wall 4*a* of the connector housing 4, and are arranged in a generally grid pattern. Therefore, the bottom wall 4*a* of the connector housing 4 isolates the plurality of terminals 5 (projecting from the lower surface 4*c* of the connector housing 4 through the respective openings defined respectively by the opening peripheral surfaces 8) from one another.

As shown in FIG. 3, each of the terminals 5 is a so-called press-fit terminal, and is in the form of a generally square or rectangular bar of a flattened cross-section. The terminal 5 may be plated over the entire outer surface thereof. The terminal 5 includes the male-type electrical contact portion 5*a* formed at one end portion thereof, and the electrical connection portion 5*b* formed at the other end portion thereof. This electrical connection portion 5*b* includes two leaf spring piece portions interconnected at their opposite ends with a hollow portion formed therebetween so that the electrical connection portion 5*b* can be resiliently deformed in a direction of a width thereof. The electrical connection portion 5*b*, when press-fitted into the through-hole land 3, is brought into contact with the inner peripheral surface of the through-hole land 3 because of its resilient restoring force, and therefore is electrically connected thereto. The terminal 5 further includes a plurality of retaining projections 5*c* formed at widthwise-opposite side edges of that portion of a terminal body disposed between the electrical contact portion 5*a* and the electrical connection portion 5*b*. When the terminal 5 is inserted into the terminal receiving chamber 6 to be received therein, these retaining projections 5*c* are brought into biting engagement with the inner peripheral surface of the connector housing 4 defining the terminal receiving chamber 6, thereby fixing the terminal 5 within the terminal receiving chamber 6.

As shown in FIG. 4, the onboard connector 1 is mounted on the circuit board 2 in such a manner that the electrical connection portions 5*b* of the plurality of terminals 5, inserted in the respective terminal receiving chambers 6 of the connector housing 4, are press-fifted in the respective through-hole lands 3 in the circuit board 2 and that the lower surface 4*c* of the connector housing 4 is held against the surface of the circuit board 2. At this time, the openings (in other words, the plating shaving-receiving spaces 7), defined respectively by the plurality of opening peripheral surfaces 8, are closed by the circuit board 2 which here functions like a lid.

As described above, in the onboard connector 1, there are provided the plating shaving-receiving spaces 7 each for receiving shavings 9 which are scraped or shaved from the plating on the electrical connection portion 5*b* by the through-hole land 3 when the electrical connection portion 5*b* is press-fitted into the through-hole land 3. The onboard connector 1 is mounted on the circuit board 2 in such a manner that the lower surface 4*c* of the connector housing 4 is disposed in intimate contact with the one surface 2*a* of the upper and lower surfaces of the circuit board 2, with the openings of the terminal receiving chambers 6 closed by the circuit board.

Therefore, even when plating shavings 9 are produced, these plating shavings 9 are received in the plating shaving-receiving spaces 7 which are closed by the circuit board 2, and are formed independently of one another by the opening peripheral surfaces 8 of the respective terminal receiving chambers 6. Therefore, any plating shaving 9 will not move to the adjacent terminal 5. Therefore, the short-circuiting between the adjacent terminals 5 by the plating shaving 9 can be positively prevented, so that the reliability of the onboard connector 1 is enhanced.

In the onboard connector 1, the opening peripheral surface 8 is formed such that the terminal receiving chamber 6 spreads outward toward the lower surface 4*c* of the connector housing 4, and is open to this lower surface 4*c*, and therefore the plating shaving-receiving space 7 of a sufficient capacity can be formed, and this is desirable.

(Modified Example)

Next, the modified example of the onboard connector 1 will be described with reference to FIGS. 5 and 6. This modified onboard connector differs from the above-mentioned onboard connector 1 only in that part of a connector housing is different in shape, and the other portions are the same as the above-mentioned onboard connector 1, and therefore the identical portions will be designated by identical or corresponding reference numerals, respectively, and explanation thereof will be simplified or omitted.

In this modified example, the frame-like projections 4*d* are formed on and project from a lower surface 4*c* of the connector housing 4 in a manner to surround openings, and the frame-like distal end surfaces 4*cs* of the frame-like projections 4*d* are entirely held in intimate contact with the one surface 2*a* of the upper and lower surfaces of the circuit board 2 as shown in FIGS. 5 and 6.

Therefore, the intimate contact between the connector housing 4 and the circuit board 2 is enhanced by the frame-like distal end surfaces 4*cs* of the frame-like projections 4d held against the circuit board 2, and a gap is prevented from being formed between the connector housing 4 and the circuit board 2. The frame-like projections 4*d* can be easily formed at the time of molding the connector housing 4 by a synthetic resin. The other operations and advantageous effects will be easily appreciated from the description given above with reference to FIGS. 1 to 4, and therefore explanation thereof will be omitted here.

The present invention is not limited to the above embodiment and modified example, and suitable modifications, improvements, etc., can be made. Furthermore, the material, shape, dimensions, numerical value, form, number, disposition, etc., of each of the constituent elements of the above embodiment and modified example are arbitrary, and are not limited in so far as the invention can be achieved.

In the above embodiment, each terminal receiving chamber 6 is formed into a spreading shape by the opening peripheral surface 8, thereby forming the plating shaving-receiving space 7. However, instead of this construction, that portion of the terminal 5, surrounded by the opening peripheral surface 8, can be made thin so as to form a modified plating shaving-receiving space 7.

In the above embodiment, the opening peripheral surface 8 is formed to increase or spread the inner peripheral surface (defining the terminal receiving chamber 6) in a stepped manner to thereby form a recess. However, instead of this construction, the inner peripheral surface, defining the terminal receiving chamber 6, can be formed, for example, to spread or flare like a bell of a trumpet or can be formed into any other suitable shape.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The present application is based on Japan Patent Application No. 2005-289105 filed on September 30, the contents of which are incorporated herein for reference.

What is claimed is:

1. An onboard connector adapted to be mounted on one an upper face of a circuit board so that the onboard connector is electrically connected to through-hole lands extending through from the upper face to a lower face of the circuit board, the onboard connector comprising:

a plurality of terminals, each of which having:

a first electrical contact portion formed at one end portion thereof for electrically connecting a mating connector; and a second electrical contact portion formed at the other end portion thereof for being press-fitted into the corresponding through-hole land to electrically contact an inner peripheral surface of the through-hole land, the second electrical contact portion being plated; and a connector housing including a plurality of terminal receiving chambers which are open to a lower face of the connector housing, wherein the terminals are received in the connector housing so that the second electrical contact portions project from the lower surface of the connector housing through openings of the respective terminal receiving chambers; and wherein an opening peripheral surface of each terminal receiving chamber which defines the opening to the lower face of the connector housing forms a plating shaving-receiving portion for receiving plating shavings which are shaved from the plating on the second electrical contact portion by the through-hole land when the second electrical contact portion is press-fifted into the through-hole land.

2. The onboard connector according to claim 1, wherein each of the terminals has:

a holding portion which is held by the connector housing; and an intermediate portion which is provided between the holding portion and the second electrical contact portion; and wherein each of the plating shaving-receiving portions receives the intermediate portion of the each terminal.

3. The onboard connector according to claim 1, wherein each of the opening peripheral surfaces is formed such that the terminal receiving chamber spreads outward toward the lower surface of the connector housing, and is open to the lower face.

4. The onboard connector according to claim 1, wherein the connector housing has frame-like projections provided on the lower face of the connector housing to be attached to the circuit board; and wherein the projections respectively surround the openings.

5. The onboard connector according to claim 4, wherein the projections are in contact with the circuit board to close the openings of the terminal receiving chambers after the terminals are press-fitted, so that plate shavings are captured in the plate shaving receiving portions.

6. The onboard connector according to claim 1, wherein each terminal receiving chamber closes against the upper face of the circuit board after the second electrical contact portion is press-fitted into the through-hole land, so that the plate shavings are captured in the plate shaving receiving portion.

7. The onboard connector according to claim 1, wherein, in the region of the shaving receiving portion, on all sides of the terminal, the distance between the wall of the terminal receiving chamber and the terminal is equal to or greater than the width of the terminal for most of the length of the terminal receiving chamber.

8. The onboard connector according to claim 1, wherein the respective plate shaving receiving portion has the shape of a rectangular prism.

9. A system, comprising:

a printed circuit board, and an onboard connector;

wherein the circuit board comprises:

an upper face for receiving the mounted onboard connector, and though-hole lands extending through from the upper face to a lower face of the circuit board;

wherein the onboard connector comprises:

a plurality of terminals, each of which having:

a first electrical contact portion formed at one end portion thereof for electrically connecting a mating connector; and a second electrical contact portion formed at the other end portion thereof for being press- fitted into the corresponding through-hole land to electrically contact an inner peripheral surface of the through-hole land, the second electrical contact portion being plated; and a connector housing including a plurality of terminal receiving chambers which are open to a lower face of the connector housing, wherein the terminals are received in the connector housing so that the second electrical contact portions project from the lower surface of the connector housing through openings of the respective terminal receiving chambers;

wherein an opening peripheral surface of each terminal receiving chamber which defines the opening to the lower face of the connector housing forms a plating shaving-receiving portion for receiving plating shavings which are shaved from the plating on the second electrical contact portion by the through-hole land when the second electrical contact portion is press-fifed into the through-hole land; and wherein the mounted onboard connector captures within the plate shaving receiving portion the plate shavings produced by the respective terminals.

10. The system according to claim 9, wherein the lower face of the connector housing is in contact with the circuit board to close the openings of the terminal receiving chambers after the terminals are press-fined, so that plate shavings are captured in the plate shaving receiving portions.

* * * * *